United States Patent [19]

James

[11] Patent Number: 4,729,822

[45] Date of Patent: Mar. 8, 1988

[54] ELECTROLYTIC CELL

[75] Inventor: Stephen R. James, Macclesfield, England

[73] Assignee: Imperial Chemical Industries PLC, London, England

[21] Appl. No.: 916,101

[22] Filed: Oct. 7, 1986

[30] Foreign Application Priority Data

Oct. 22, 1985 [GB] United Kingdom ..... 8526054

[51] Int. Cl.[4] ..... C25B 9/00; C25B 15/08; C25B 13/00

[52] U.S. Cl. ..... 204/255; 204/257; 204/263

[58] Field of Search ..... 204/253-258, 204/263

[56] References Cited

U.S. PATENT DOCUMENTS

| | | | |
|---|---|---|---|
| 4,196,069 | 4/1980 | Mose et al. | 204/257 |
| 4,252,628 | 2/1981 | Boulton et al. | 204/257 |
| 4,371,433 | 2/1983 | Balko et al. | 204/255 X |
| 4,426,270 | 1/1984 | Schmitt et al. | 204/257 |
| 4,464,243 | 8/1984 | Woolhouse | 204/257 |
| 4,490,231 | 12/1984 | Boulton | 204/263 |
| 4,571,288 | 2/1986 | Boulton | 204/257 X |
| 4,589,968 | 5/1986 | Toomey, Jr. | 204/257 |

FOREIGN PATENT DOCUMENTS

| | | |
|---|---|---|
| 0064608 | 4/1982 | European Pat. Off. . |
| 071754 | 2/1983 | European Pat. Off. . |
| 080287 | 6/1983 | European Pat. Off. . |
| 120628 | 2/1984 | European Pat. Off. . |
| 1595183 | 8/1981 | United Kingdom . |

*Primary Examiner*—Donald R. Valentine

*Attorney, Agent, or Firm*—Cushman, Darby & Cushman

[57] ABSTRACT

An electrolytic cell of the filter-press type which comprises plate-like anodes, cathodes, and gaskets of an electrically-insulating material, and an ion-exchange membrane between each anode and adjacent cathode to form in the cell a plurality of anode compartments and cathode compartments, the gaskets, and optionally the anodes and cathodes, each containing apertures therein which form headers from which liquors may be charged to the anode and cathode compartments of the cell and to which products of electrolysis may be removed from the anode and cathode compartments of the cell, and in which the gaskets, and optionally the anodes and cathodes, each comprise an aperture therein which together form a compartment lengthwise of the cell which is in communication only with the anode compartments of the cell, or which is in communication only with the cathode compartments of the cell, and which serves as a balancing header.

16 Claims, 4 Drawing Figures

ELECTROLYTIC CELL

Figure 1:
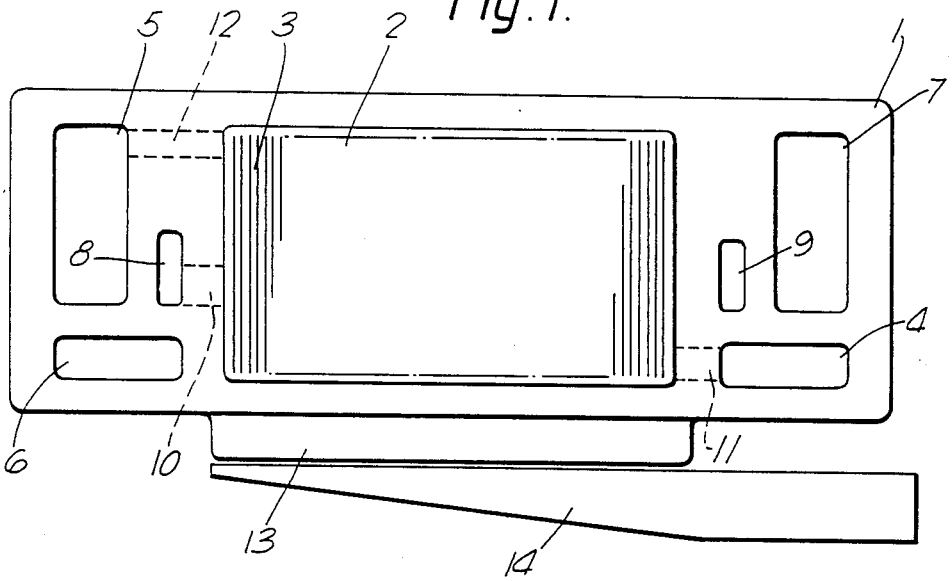

This invention relates to an electrolytic cell and in particular to an electrolytic cell of the filter press type.

Electrolytic cells are known comprising a plurality of anodes and cathodes with each anode being separated from an adjacent cathode by a separator which divides the electrolytic cell into a plurality of anode and cathode compartments. The anode compartments of such a cell are provided with means for charging electrolyte to the cell, suitably from a common header, and with means for removing products of electrolysis from the cell. Similarly, the cathode compartments of the cell are provided with means for removing products of electrolysis from the cell, and optionally with means for charging water or other liquors to the cell, suitably from a common header.

In such electrolytic cells the separator may be a substantially hydraulically impermeable ionically permselective membrane, e.g. a cation permselective membrane.

Electrolytic cells of the filter press type may comprise a large number of alternating anodes and cathodes, for example, fifty anodes alternatively with fifty cathodes, although the cell may comprise even more anodes and cathodes, for example up to one hundred and fifty anodes and cathodes. The anodes and cathodes may be of plate-like construction and they may be electrically insulated one from another by means of gaskets of an electrically insulating material.

Although electrolytic cells of the filter press membrane type are useful in the electrolysis of a wide variety of electrolytes they have been developed in recent years primarily for use in the production of chlorine and aqueous alkali metal hydroxide solution by the electrolysis of aqueous alkali metal chloride solution.

Where aqueous alkali metal chloride solution is electrolysed in an electrolytic cell of the membrane type the solution is charged to the anode compartments of the cell and chlorine produced in the electrolysis and depleted alkali metal chloride solution are removed from the anode compartments, alkali metal ions are transported across the membranes to the cathode compartments of the cell to which water or dilute alkali metal hydroxide solution is charged, and hydrogen and alkali metal hydroxide solution produced by the reaction of alkali metal ions with hydroxyl ions are removed from the cathode compartments of the cell.

In such electrolytic cells of the filter press type the electrolyte may be charged from a header to the individual anode compartments of the cell and the water or dilute alkali metal hydroxide solution may be charged from a header to the individual cathode compartments of the cell, and the products of electrolysis may be removed from the individual anode and cathode compartments of the cell by feeding the products to separate headers. The means for charging the electrolyte and water or dilute alkali metal hydroxide solution, and the means for removing the products of electrolysis, may be separate pipes providing communication between the headers and each anode and cathode compartment of the electrolytic cell. Alternatively, the electrolytic cell may be formed from a plurality of anode plates, cathode plates and gaskets of an electrically insulating material with the gaskets being positioned between adjacent anode plates and cathode plates thereby insulating each anode plate from the adjacent cathode plate, or the anode plates and cathode plates may be positioned within the gaskets, e.g. in recesses in frame-like gaskets, and the gaskets, and optionally the anode and cathode plates, may comprise a plurality of openings therein which in the cell together form a plurality of channels lengthwise of the cell which serve as the headers. In such cells the means of charging the electrolyte and removing the products of electrolysis may be passageways, for example slots, in the walls of the gaskets and/or of the anode plates or cathode plates which passageways connect the headers to the anode and cathode compartments of the electrolytic cell. Electrolytic cells of these types are described for example in British patent No. 1595183 and in European patent application No. 0064608-A.

In electrolytic cells, and particularly in electrolytic cells of the filter press type comprising a large number of individual anode and cathode compartments, it is very desirable that the rate of flow of electrolyte should be substantially the same to each of the anode compartments, that is that there should be an even distribution of electrolyte from the header to the anode compartments. If there are different rates of flow of electrolyte from the header to the anode compartments the average concentration of electrolyte and the temperature of the electrolyte may vary from anode compartment to anode compartment, with consequent adverse effect on the efficiency of operation of the electrolytic cell. Furthermore, and particularly where the electrolytic cell is operated at elevated pressure, it is particularly important that the pressure in each anode compartment of the electrolytic cell should be substantially the same. Similarly, it is very desirable that there should be an even distribution of liquors in the cathode compartments of the cell, and thus that there should be little or no variation in the concentration of the liquors and the temperature thereof in the cathode compartments of the cell, and that when the electrolytic cell is operated at elevated pressure the pressure in each of the cathode compartments of the electrolytic cell should be substantially the same.

The present invention relates to an electrolytic cell which is provided with means which assist in maintaining an even distribution of liquors to the anode compartments and/or to the cathode compartments of the electrolytic cell and which assists in maintaining a similar pressure in each of the anode compartments and/or a similar pressure in each of the cathode compartments.

The present invention provides an electrolytic cell of the filter-press type which comprises a plurality of plate-like anodes, cathodes, and gaskets of an electrically-insulating material, and an ionexchange membrane positioned between each anode and adjacent cathode to form in the cell a plurality of anode compartments and cathode compartments, in the electrolytic cell the gaskets, and optionally the anodes and cathodes, each containing a plurality of apertures therein which in the electrolytic cell form compartments lengthwise of the cell which serve as headers from which electrolyte may be charged to the anode compartments of the cell and from which liquors may be charged to the cathode compartments of the cell, and to which products of electrolysis may be removed from the anode compartments and cathode compartments of the cell, the cell being provided with means of communication between the said headers and the anode and cathode compartments, in which the gaskets, and optionally the anodes and cathodes, each comprise an aperture therein which together form a compartment lengthwise of the cell which is in communication only with the anode compartments of the cell, or which is in communication only with the cathode compartments of the cell, and which serves as a balancing header.

In a first type of electrolytic cell the anodes and cathodes may be positioned in recesses in a frame-like gasket and in this case the headers from which, respectively, electrolyte may be charged to the anode compartments of the cell and from which liquors may be charged to the cathode compartments of the cell, and to which, respectively, products of electrolysis may be removed from the anode compartments and cathode compartments of the cell, are formed by apertures in each of the gaskets which together form the headers in the electrolytic cell. In this type of cell the means communicating the headers with the anode and cathode compartments of the cell may be appropriately positioned channels in the plane of the gaskets, such as channels within the wall of the gasket or channels on the surfaces of the gaskets.

In an alternative second type of electrolytic cell gaskets, which may be of frame-like construction, may be positioned between each anode and adjacent cathode, thereby insulating each anode from the adjacent cathode, and in this case the headers from which, respectively, electrolyte may be charged to the anode compartments of the cell and from which liquors may be charged to the cathode compartments of the cell, and to which, respectively, products of electrolysis may be removed from the anode compartments and cathode compartments of the cell, are formed by apertures in each of the gaskets, the anodes, and the cathodes, which together form the headers in the electrolytic cell. In this type of cell the means communicating the headers with the anode and cathode compartments of the cell may be appropriately positioned channels in the plane of the gaskets, or channels in the plane of the anodes and in the plane of the cathodes, such as channels within the walls or channels on the surfaces of the gaskets, anodes or cathodes.

In general the gaskets, and optionally the anodes and cathodes, will contain four apertures therein which in the electrolytic cell form four compartments lengthwise of the cell which serve as headers from which, respectively, electrolyte may be charged to the anode compartments of the cell and from which liquors may be charged to the cathode compartments of the cell, and to which respectively, products of electrolysis may be removed from the anode compartments and cathode compartments of the cell. The electrolytic cell is not limited to the case where the gaskets, and optionally the anodes and cathodes, contain four such apertures which form four compartments lengthwise of the cell which serve as headers. The gaskets, and optionally the anodes and cathodes, may contain more than four such apertures. However, the electrolytic cell will be described hereafter by reference to four such apertures.

In the electrolytic cell the anodes, cathodes, and gaskets are plate-like by which we mean that they are of substantially planar construction, although it is to be understood that the anodes, cathodes, and gaskets need not be precisely planar.

The electrolytic cell may be monopolar or it may be bipolar. In a monopolar electrolytic cell an ion-exchange membrane is positioned between each anode and adjacent cathode. In a bipolar electrolytic cell an ion-exchange membrane is positioned between each anode of a bipolar electrode and a cathode of an adjacent bipolar electrode.

In the electrolytic cell a balancing header is in communication with each of the anode compartments or with each of the cathode compartments of the cell. In a preferred embodiment the electrolytic cell comprises a balancing header in communication with each of the anode compartments and a separate balancing header in communication with each of the cathode compartments.

In the first type of electrolytic cell as herein described a balancing header is formed by an aperture in each of the gaskets, these apertures in the electrolytic cell together forming a compartment lengthwise of the cell which serves as the balancing header. The means of communication with the anode or cathode compartments may be provided by a channel in the plane of at least some of the gaskets, e.g. in the wall of the gasket or on the surface of the gasket. Whether or not a particular gasket is provided with such a channel depends on whether the balancing header is in communication with the anode compartments or cathode compartments of the electrolytic cell. The channel should have a substantial cross-sectional area in order that it does not provide a significant pressure drop and in order that it fulfils its function of rapidly equalising pressure and liquor levels in the anode compartments or the cathode compartments.

In the second type of electrolytic cell as herein described the balancing header is formed by an aperture in each of the gaskets, the anodes and the cathodes, these apertures in the electrolytic cell together forming a compartment lengthwise of the cell which serves as a balancing header. The means of communication with the anode or cathode compartments may be provided by a channel in the plane of at least some of the gaskets, e.g. in the wall of the gasket or on the surface of the gasket, or a similar channel in the plane of the anodes or the cathodes. Whether or not a particular gasket or anode or cathode is provided with such a channel depends on whether the balancing header is in communication with the anode compartments or cathode compartments of the electrolytic cell.

The gaskets, and the anodes and cathodes where necessary, may each comprise two apertures which in the electrolytic cell form two balancing headers one of which is in communication only with the anode compartments and the other of which is only in communication with the cathode compartments.

In the electrolytic cell the balancing header should be positioned below the level at which the liquor is designed to reach in the anode compartment, or in the cathode compartment, as the case may be, when the cell is operating.

Hydraulically impermeable ion-exchange membranes are known in the art and are preferably fluorine-containing polymeric materials containing anionic groups. The polymeric materials preferably are fluorocarbons containing the repeating groups $$[C_mF_{2m}]_M \text{ and } [CF_2-\underset{\underset{X}{|}}{CF}]_N$$

where m has a value of 2 to 10, and is preferably 2, the ratio of M to N is preferably such as to give an equivalent weight of the groups X in the range 500 to 2000, and X is chosen from

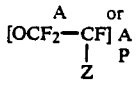

where P has the value of for example 1 to 3, Z is fluorine or a perfluoroalkyl group having from 1 to 10 carbon atoms, and A is a group chosen from the groups:

—$SO_3H$
—$CF_2SO_3H$
—$CCl_2SO_3H$
—$X^1SO_3H$
—$PO_3H_2$
—$PO_2H_2$
—COOH and
—$X^1OH$ or derivatives of the said groups, where $X^1$ is an aryl group. Preferably A represents the group $SO_3H$ or —COOH. $SO_3H$ group-containing ion exchange membranes are sold under the tradename 'Nafion' by E I DuPont de Nemours and Co Inc and —COOH group-containing ion exchange membranes under the tradename 'Flemion' by the Asahi Glass Co Ltd.

The electrolytic cell comprises a plurality of gaskets of electrically insulating material. The gaskets are desirably flexible and preferably resilient in order to aid the production of leak-tight seals in the electrolytic cell, and they should be resistant to the electrolyte and to the products of electrolysis. The gasket may be made of an organic polymer, for example a polyolefin, e.g. polyethylene or polypropylene; a hydrocarbon elastomer, e.g. an elastomer based on ethylene-propylene copolymers or ethylene-propylene-diene copolymers, natural rubber, or styrene-butadiene rubber; or a chlorinated hydrocarbon, e.g. polyvinyl chloride or polyvinylidene chloride. In an electrolytic cell for the electrolysis of aqueous alkali metal chloride solution the material of the gasket may be a fluorinated polymeric material, for example polytetra-fluoroethylene, polyvinyl fluoride, polyvinylidene fluoride, or a tetrafluoroethylenehexafluoropropylene copolymer, or a substrate having an outer layer of such a fluorinated polymeric material or filled with such a material.

In the electrolytic cell the gasket may comprise a central opening defined by a frame-like section, which in the cell defines a part of the anode compartment or cathode compartment and in which the anodes or cathodes may optionally be positioned. The apertures in the gasket which in the electrolytic cell together form a part of headers from which, respectively, electrolyte may be charged to the anode compartments of the cell and from which liquors may be charged to the cathode compartments of the cell, and to which, respectively, products of electrolysis may be removed from the anode compartments and cathode compartments of the cell, may be positioned in pairs near to opposite edges of the gasket, e.g. in the frame-like section of the gasket. The apertures which in the electrolytic cell together form the balancing header or headers may similarly be positioned in a frame-like section of the gasket.

The anode may be metallic and the nature of the metal will depend on the nature of the electrolyte to be electrolysed in the electrolytic cell. A preferred metal is a film-forming metal, particularly where an aqueous solution of an alkali metal chloride is to be electrolysed in the cell.

The film-forming metal may be one of the metals titanium, zirconium, niobium, tantalum or tungsten or an alloy consisting principally of one or more of these metals and having anodic polarisation properties which are comparable with those of the pure metal. It is preferred to use titanium alone, or an alloy based on titanium and having polarisation properties comparable with those of titanium.

The anode may have at least a central anode portion and, where it comprises apertures which in the cell form a part of the headers from which, respectively, electrolyte may be charged to the anode compartments of the cell and from which liquors may be charged to the cathode compartments of the cell, and to which, respectively, products of electrolysis may be removed from the anode compartments and cathode compartments of the cell, the apertures may be positioned in pairs near to opposite edges of the anode, e.g. on either side of a central anode portion. Where the anodes comprise apertures which in the electrolytic cell together form a part of a balancing header or headers the apertures may be positioned similarly near the edge of the anode and to the side of a central anode portion.

The anode portion may be foraminate, for example, it may comprise a plurality of elongated members, which are preferably vertically disposed, for example in the form of louvres or strips, or it may comprise a foraminate surface in the form of a mesh, expanded metal or a perforated surface. The anode portion may comprise a pair of foraminate surfaces disposed substantially parallel to each other.

The anode portion of the anode may carry a coating of an electroconducting electrocatalytically active material. Particularly in the case where an aqueous solution of an alkali metal chloride is to be electrolysed this coating may for example consist of one or more platinum group metals, that is platinum, rhodium, iridium, ruthenium, osmium and palladium, or alloys of the said metals, and/or an oxide or oxides thereof. The coating may consist of one or more of the platinum group metals and/or oxides thereof in admixture with one or more non-noble metal oxides, particularly a film-forming metal oxide. Especially suitable electrocatalytically active coatings include platinum itself and those based on ruthenium dioxide/titanium dioxide, ruthenium dioxide/tin dioxide, and ruthenium dioxide/tin dioxide/-titanium dioxide.

Such coatings, and methods of application thereof, are well known in the art.

The cathode may be metallic and the nature of the metal will also depend on the nature of the electrolyte to be electrolysed in the electrolytic cell. Where an aqueous solution of an alkali metal chloride is to be electrolysed the cathode may be made, for example, of steel, copper, nickel or copper - or nickel-coated steel.

The cathode will have at least a central cathode portion and, where it comprises apertures which in the cell form a part of the headers from which, respectively, electrolyte may be charged to the anode compartments of the cell and from which liquors may be charged to the cathode compartments of the cell, and to which, respectively, products of electrolysis may be removed from the anode compartments and cathode compartments of the cell, the apertures may be positioned in pairs near to opposite edges of the cathodes, e.g. on either side of a central cathode portion. Where the cathode comprises apertures which in the electrolytic cell together form a part of a balancing header or headers the apertures may be positioned similarly near to the edge of the cathode and to the side of a central cathode portion.

The cathode portion may be foraminate, for example, it may comprise a plurality of elongated members, which are preferably vertically disposed, for example in the form of louvres or strips, or it may comprise a foraminate surface in the form of a mesh, expanded metal or perforated surface. The cathode portion may comprise a pair of foraminate surfaces disposed substantially parallel to each other.

The cathode portion of the cathode may carry a coating of a material which reduces the hydrogen overvoltage at the cathode when the electrolytic cell is used in the electrolysis of aqueous alkali metal chloride solution. Such coatings are known in the art.

In a monopolar cell each of the anodes and cathodes will be provided with means for attachment to a power source. For example, they may be provided with extensions which are suitable for attachment to appropriate bus-bars. In a bipolar cell the terminal anode and terminal cathode will be provided with means for attachment to a power source.

It is desirable that both the anodes and cathodes are flexible, and preferably that they are resilient, as flexibility and resiliency assists in the production of leak-tight seals when the anodes and cathodes are assembled into an electrolytic cell.

The thickness of the anodes and cathodes, is suitably in the range 0.5 mm to 3 mm.

Where the anodes and cathodes comprise apertures which in the electrolytic cell from a part of the headers from which, and to which, liquors and products of electrolysis are charged, it is necessary to ensure that the headers which are in communication with the anode compartments of the cell are insulated electrically from the headers which are in communication with the cathode compartments of the cell. This electrical insulation may be achieved by means of frame-like members of electrically insulating material inserted in the apertures in the anodes and cathodes which form a part of the headers. The frame-like members may form a part of the gaskets, e.g. an upstanding frame-like part on a surface of the gasket.

Figure 2:
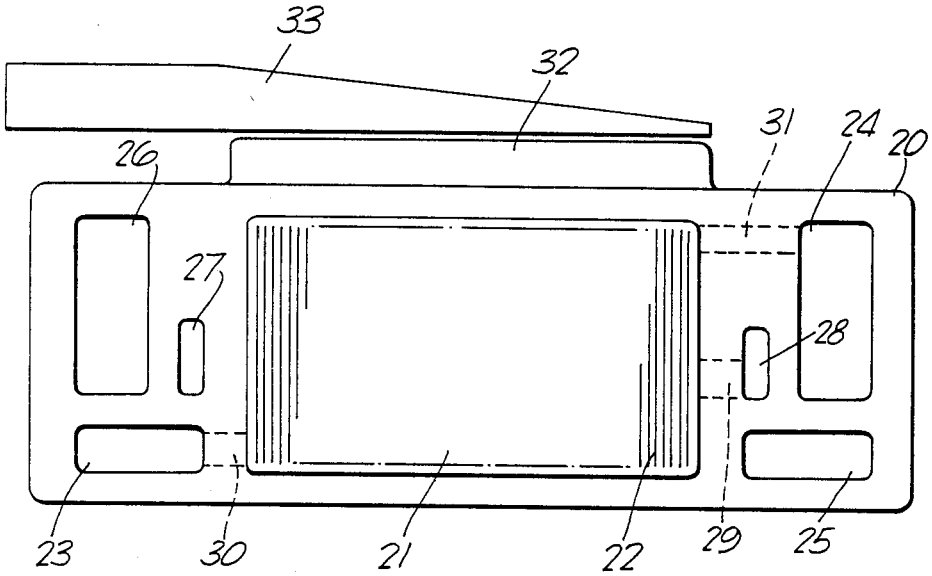
Figure 3:
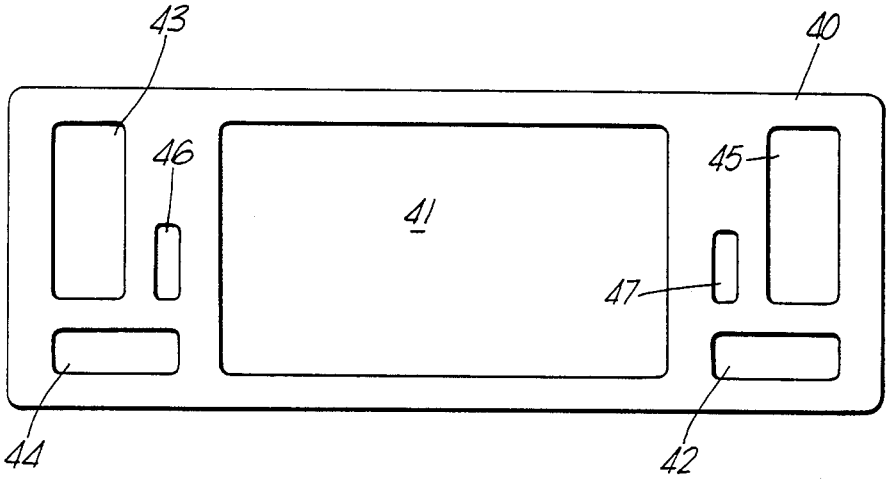
Figure 4:
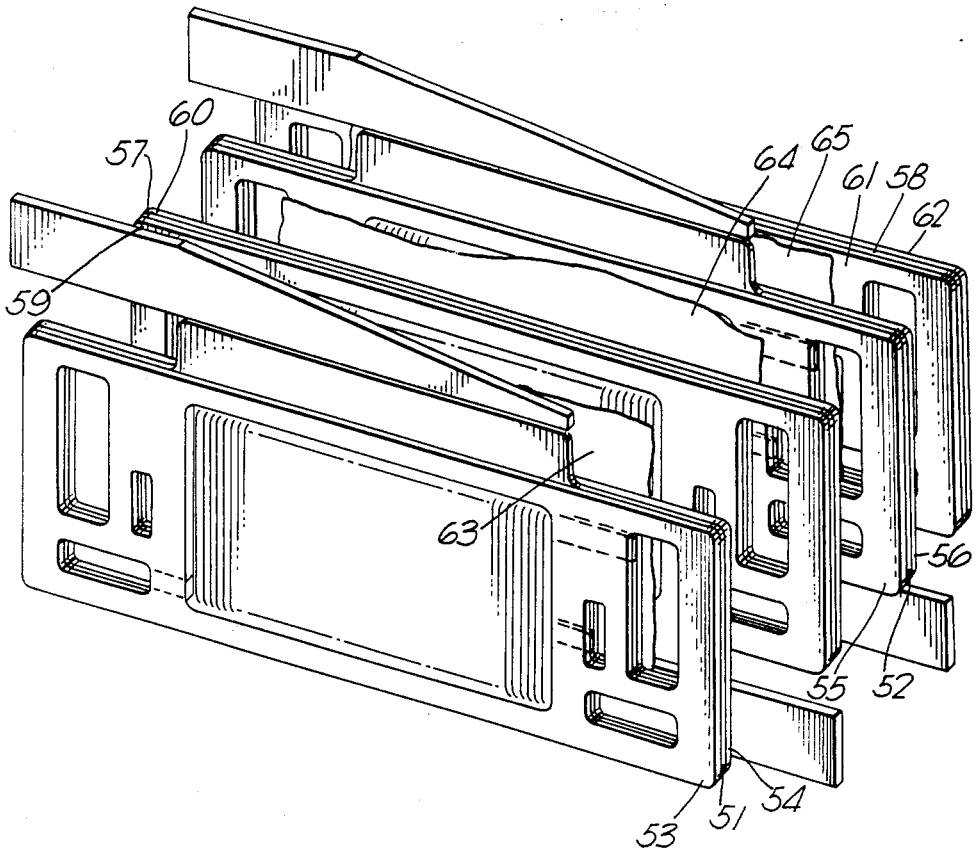

Specific embodiments of the electrolytic cell will now be described with the aid of the following drawings in which FIG. 1 is a view in elevation of an anode, FIG. 2 is a view in elevation of a cathode, FIG. 3 is a view in elevation of a gasket, and FIG. 4 is an exploded isometric view of a part of an electrolytic cell incorporating the anodes, cathodes and gaskets of FIGS. 1, 2 and 3.

Referring to FIG. 1 the anode comprises a plate (1) having a central opening (2) which is bridged by a plurality of vertically disposed strips (3) which form the active anode surface. These strips (3) are displaced from and lie in a plane parallel to that of the plate (1). A group of strips is positioned on each side of the plate (1). The plate (1) comprises four apertures (4, 5, 6, 7) which in the cell form a part of separate lengthwise headers for, respectively, electrolyte to be charged to the anode compartments, products of electrolysis to be removed from the anode compartments, liquor to be charged to the cathode compartments, and products of electrolysis to be removed from the cathode compartments. The anode plate (1) also comprises two further apertures (8, 9) which in the electrolytic cell form a part of compartments lengthwise of the cell and which serve as balancing headers. The aperture (8) is in communication via Passageway (10) in the wall of the anode plate (1) with central opening (2) and thus with the anode compartments of the cell. The aperture (9) is not connected to a similar passageway thus it is not in communication with the central opening (2) and with the anode compartment of the cell. The anode plate (1) is also provided with a passageway (11) connecting the aperture (4) with the central opening (2), and with a passageway (12) connecting the central opening (2) with the aperture (5). The anode plate (1) is also provided with a projection (13) which is connected to a lead (14) for connection to a bus-bar.

Referring to FIG. 2 the cathode comprises a plate (20) having a central opening (21) which is bridged by a plurality of vertically disposed strips (22) which form the active cathode surface. These strips (22) are displaced from and lie in a plane parallel to that of the plate (20). A group of strips is positioned on each side of the plate (20). The plate (20) comprises four apertures (23, 24, 25, 26) which in the cell form a part of separate lengthwise headers for, respectively, liquor to be charged to the cathode compartments, products of electrolysis to be removed from the cathode compartments, electrolyte to be charged to the anode compartments, and products of electrolysis to be removed from the anode compartments. The cathode plate (20) also comprises two further apertures (27, 28) which in the electrolytic cell form a part of compartments lengthwise of the cell and which serve as balancing headers. The aperture (28) is in communication via passageway (29) in the wall of the cathode plate (20) with central opening (21) and thus with the cathode compartment of the cell. The aperture (27) is not connected to a similar passageway thus it is not in communication with the central opening (21) and with the cathode compartments of the cell. The cathode plate (20) is also provided with a passageway (30) connecting the aperture (23) with the central opening (21), and with a passageway (31) connecting the central opening (21) with the aperture (24). The cathode plate (20) is also provided with a projection (32) which is connected to a lead (33) for connection to a bus-bar.

Referring to FIG. 3 the gasket (40) of electrically insulating elastomeric material comprises a central opening (41) corresponding to the central opening (2) in the anode plate (1), and apertures (42, 43, 44, 45, 46, 47) corresponding to the apertures (4, 5, 6, 7, 8, 9) in the anode plate (1) but having slightly smaller dimensions than these latter apertures in the anode plate (1). The apertures (42, 43, 44, 45, 46, 47) in the gasket (40) comprise upstanding peripheral lips (not shown) which in the assembled cell fit into the apertures (4, 5, 6, 7, 8, 9) in the anode plate (1), or into the apertures (23, 24, 25, 26, 27, 28) in the cathode plate (20) as the case may be, thus providing a surface of an electrically insulating material in the said apertures in the anode plate (1) and cathode plate (20).

Referring to FIG. 4 there is shown a part of an electrolytic cell comprising two cathodes (51, 52) each of which has a pair of gaskets of an elastomeric material (53, 54 and 55, 56) positioned on either side thereof. The part of the cell shown also comprises two anodes (57, 58) each of which has a pair of gaskets of an elastomeric material (59, 60 and 61, 62) positioned on either side thereof. Also shown are three ion-exchange membranes (63, 64, 65), a membrane being positioned between each anode and adjacent cathode. The boundaries of an anode compartment are formed by membranes (63) and (64), and the boundaries of a cathode compartment are formed by membranes (64) and (65). The electrolytic cell is also provided with end plates (not shown) and with means (not shown) for charging liquors to the headers and for removing products of electrolysis from the headers.

Operation of the electrolytic cell will be described with reference to the anodes and cathodes illustrated respectively in FIGS. 1 and 2.

Referring to FIG. 1, electrolyte, e.g. aqueous alkali metal chloride solution, is charged to the header of which aperture (4) in anode plate (1) forms a part, and the electrolyte passes through passageway (11) into the anode compartment of the cell of which opening (2) in anode plate (1) forms a part. Gaseous and liquid products of electrolysis flow out of the anode compartment via passageway (12) and into the header of which aperture (5) forms a part, and thence out of the cell.

Referring to FIG. 2, liquid, e.g. water or dilute alkali metal hydroxide solution, is charged to the header of which aperture (23) in cathode plate (20) forms a part, and the liquid passes through passageway (29) into the cathode compartment of the cell of which opening (21) in cathode plate (20) forms a part. Gaseous and liquid products of electrolysis flow out of the cathode compartment via passageway (30) and into the header of which aperture (24) forms a part, and thence out of the cell.

In operation of the electrolytic cell the balancing header of which aperture (8) in anode plate (1) forms a part is in communication with each of the anode compartments of the cell via passageways (10) in each anode plate (1) thereby permitting flow of electrolyte between anode compartments and ensuring that there is an even distribution of electrolyte and a constant pressure in each of the anode compartments of the cell. The balancing header of which aperture (28) in cathode plate (20) forms a part is in communication with each of the cathode compartments of the cell via passageways (29) in each cathode plate (20) thereby permitting flow of liquor between cathode compartments and ensuring that there is an even distribution of liquor and a constant pressure in each of the cathode compartments of the cell.

I claim:

1. An electrolytic cell of the filter press type which comprises a plurality of plate-like anodes, cathodes, and gaskets of an electrically-insulating material, and an ion-exchange membrane positioned between each anode and adjacent cathode to form in the cell a plurality of anode compartments and cathode compartments, in the electrolytic cell at least the gaskets each containing a plurality of apertures therein which in the electrolytic cell form compartments lengthwise of the cell which serve as headers from which electrolyte may be charged to the anode compartments of the cell and from which liquors may be charged to the cathode compartments of the cell, and to which products of electrolysis may be removed from the anode compartments and cathode compartments of the cell, the cell being provided with means of communication between the said headers and the anode and cathode compartments, in which at least the gaskets each comprise an aperture therein which together form a compartment lengthwise of the cell which is in communication only with the anode compartments of the cell, or which is in communication only with the cathode compartments of the cell, and which serves as a balancing header.

2. An electrolytic cell as claimed in claim 1 in which the anodes and cathodes are positioned in recesses in frame-like gaskets and in which the headers from which electrolyte may be charged to the anode compartments of the cell and from which liquors may be charged to the cathode compartments of the cell, and to which products of electrolysis may be removed from the anode compartments and cathode compartments of the cell, are formed by apertures in each of the gaskets which together form the headers in the electrolytic cell 3. An electrolytic cell as claimed in claim 2 in which the means of communication between the headers and the anode and cathode compartments are channels in the plane of the gaskets.

4. An electrolytic cell as claimed in any one of claims 1 to 3 in which the gaskets each contain four apertures which together form headers in the electrolytic cell.

5. An electrolytic cell as claimed in claim 1 in which a gasket is positioned between each anode and adjacent cathode and in which the headers from which electrolyte may be charged to the anode compartments of the cell and from which liquors may be charged to the cathode compartments of the cell, and to which products of electrolysis may be removed from the anode compartments and cathode compartments of the cell, are formed by apertures in each of the gaskets, the anodes, and the cathodes, which together form the headers in the electrolytic cell.

6. An electrolytic cell as claimed in claim 5 in which the means of communication between the headers and the anode and cathode compartments are channels in the plane of the gaskets or of the anodes or of the cathodes.

7. An electrolytic cell as claimed in claim 5 or claim 6 in which the gaskets and the anodes and the cathodes each contain four apertures which together form four headers in the electrolytic cell.

8. An electrolytic cell as claimed in any one of claims 1 to 7 which is a monopolar cell.

9. An electrolytic cell as claimed in any one of claims 1 to 3, 5 and 8 in which each of the gaskets contains two apertures therein which form two compartments lengthwise of the cell which serve as balancing headers, one of which lengthwise compartments is in communication only with the anode compartments and the other of which lengthwise compartments is only in communiction with the cathode compartments.

10. An electrolytic cell as claimed in claim 9 in which communication is provided by a channel in the plane of the gaskets.

11. An electrolytic cell as claimed in any one of claims 1, 5, 6 and 7 in which each gasket, anode and cathode contains at least one aperture therein which together form a compartment lengthwise of the cell which is in communication with the anode compartments of the cell, or which is in communication with the cathode compartments of the cell, and which serves as a a balancing header.

12. An electrolytic cell as claimed in claim 11 in which each gasket, anode and cathode contain two apertures therein which form two compartments lengthwise of the cell which serve as balancing headers, one of which lengthwise compartments is in communication only with the anode compartments and the other of which lengthwise compartments is only in communication with the cathode compartments.

13. An electrolytic cell as claimed in claim 11 or claim 12 in which communication is provided by a channel in the plane of the gaskets or of the anodes or of the cathodes.

14. An electrolytic cell as claimed in any one of claims 1 to 13 in which the balancing header is positioned below the level at which the liquor is designed to reach in the anode compartment, or in the cathode compartment when the cell is operating.

15. An electrolytic cell as claimed in any one of claims 1 to 14 in which the gaskets are made of a resilient organic polymer.

16. An electrolytic cell as claimed in any one of claims 1 to 15 in which the ion-exchange membrane is a cation-exchange membrane.

* * * * *